US009586430B2

(12) United States Patent
Jones et al.

(10) Patent No.: US 9,586,430 B2
(45) Date of Patent: Mar. 7, 2017

(54) VERIFYING THE PHYSICAL CHARACTERISTIC OF PRINTED CONTENT FOR BINDING

(71) Applicant: Amazon Technologies, Inc., Reno, NV (US)

(72) Inventors: Richard E. Jones, Charleston, SC (US); Jeffrey R. Raines, Mt Pleasant, SC (US); Jeffrey I. Coker, Lexington, KY (US); Scott W. Horoho, Lexington, KY (US); Brian E. Johnson, North Charleston, SC (US)

(73) Assignee: Amazon Technologies, Inc., Seattle, WA (US)

( * ) Notice: Subject to any disclaimer, the term of this patent is extended or adjusted under 35 U.S.C. 154(b) by 198 days.

(21) Appl. No.: 14/340,219

(22) Filed: Jul. 24, 2014

(65) Prior Publication Data

US 2014/0334900 A1 Nov. 13, 2014

Related U.S. Application Data

(63) Continuation of application No. 13/303,708, filed on Nov. 23, 2011, now Pat. No. 8,827,616.

(51) Int. Cl.

| | |
|---|---|
| ***B42C 19/00*** | (2006.01) |
| ***B42C 11/02*** | (2006.01) |
| ***B42C 11/04*** | (2006.01) |
| ***B42C 11/00*** | (2006.01) |
| ***G03G 15/00*** | (2006.01) |

(52) U.S. Cl.

CPC ..... *B42C 19/00* (2013.01); *B42C 11/00* (2013.01); *B42C 11/02* (2013.01); *B42C 11/04* (2013.01); *G03G 15/6544* (2013.01); *G03G 2215/00936* (2013.01)

(58) Field of Classification Search

CPC ..... B42C 11/04; B42C 19/02; B42C 11/00; B42C 11/02

USPC ..... 412/11–12, 14; 399/408

See application file for complete search history.

(56) References Cited

U.S. PATENT DOCUMENTS

| | | | | |
|---|---|---|---|---|
| 6,000,894 | A * | 12/1999 | Suzuki | B42C 9/0068 412/11 |
| 7,281,707 | B2 * | 10/2007 | Moriyama | B42C 1/12 270/58.04 |
| 7,658,584 | B2 | 2/2010 | Yoshie et al. | |
| 7,949,293 | B2 | 5/2011 | Osawa | |
| 2007/0036638 | A1 * | 2/2007 | Yoshie | B42C 11/02 412/19 |
| 2008/0069664 | A1 * | 3/2008 | Nagata | G03G 15/6544 412/11 |
| 2008/0240888 | A1 * | 10/2008 | Yokoya | B42C 11/02 412/11 |

(Continued)

*Primary Examiner* — Kyle Grabowski

(74) *Attorney, Agent, or Firm* — Thomas Horstemeyer, LLP

(57) ABSTRACT

Disclosed are various embodiments relating to verifying a printed work comprises a correct number of pages. Associated with a stack comprising one or more pages is an identifier that may be used to obtain an expected value for a physical characteristic of the pages in the stack. A sensor may then measure an actual value for the physical characteristic of the pages in the stack. Before binding the pages in the stack, the expected value may be compared to the actual value in order to verify the stack comprises the correct number of pages.

20 Claims, 6 Drawing Sheets

(56) References Cited

U.S. PATENT DOCUMENTS

| | | | | |
|---|---|---|---|---|
| 2008/0265482 | A1 | 10/2008 | Morales | |
| 2010/0149565 | A1* | 6/2010 | Mori | G03G 15/6544 358/1.9 |
| 2010/0329822 | A1* | 12/2010 | Gear | B42C 1/12 412/6 |
| 2012/0076616 | A1* | 3/2012 | Satsukawa | B42B 5/103 412/14 |

* cited by examiner

VERIFYING THE PHYSICAL CHARACTERISTIC OF PRINTED CONTENT FOR BINDING

CROSS-REFERENCE TO RELATED APPLICATIONS

This application is a division of U.S. patent application Ser. No. 13/303,708, entitled "Verifying the Physical Characteristic of Printed Content for Binding," filed on Nov. 23, 2011, and which is incorporated by reference herein in its entirety.

BACKGROUND

A user may select printed materials online for consumption. However, in assembling printed content, the pages of multiple works may be bound together.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

DETAILED DESCRIPTION

Various embodiments of the present disclosure relate to verifying a printed work that includes a correct number of pages. In one embodiment, associated with a stack of one or more pages is an identifier that may be used to obtain an expected thickness of the stack of pages. A sensor may then measure an actual thickness of the stack of pages. Before the pages of the stack are bound, the actual thickness obtained from the sensor may be compared to the expected thickness based upon the identifier in order to verify the stack has the correct number of pages. In the following discussion, a general description of the system and its components is provided, followed by a discussion of the operation of the same.

Figure 1:
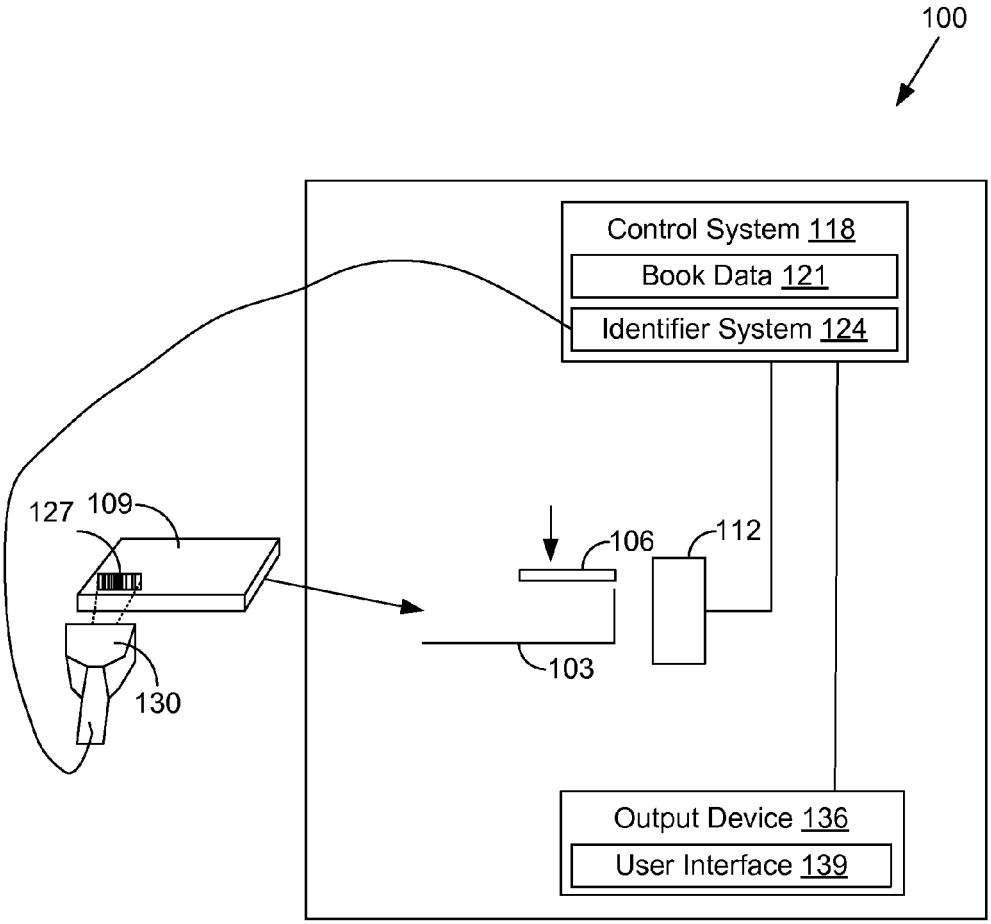
FIG. 1 is a drawing that illustrates the components of a binding machine according to various embodiments of the present disclosure.

With reference to FIG. 1, shown is a drawing that depicts one example of a binding machine 100 according to an embodiment of the present disclosure. According to the illustration provided herein, the binding machine 100 may include various components that are configured to, for example, bind the pages of printed content to a cover, such as, for example, books, magazines, newspapers, publications, journals, and any other printed work as can be appreciated.

As shown in FIG. 1, in one embodiment, the binding machine 100 may comprise, for example, a flat panel 103 or staging location, referred to herein as binder 103, and a clamp mechanism 106. A stack 109 comprising one or more pages, sometimes referred to as a book block, may be placed on the binder 103, and the clamp mechanism 106 may then close on to the stack 109 so as to clamp the stack 109 between the binder 103 and the clamp mechanism 106. Thereafter, a wheel assembly may apply a strip of glue to the spine of the stack 109 and a cover is then injected into the binder 103, thereby binding the cover to the stack 109. The clamp mechanism 106 is then released and the stack 109 may be sent to other handling stations configured to provide for the fulfillment of orders received for the consumption of printed content.

The binding machine 100 may further comprise a measuring mechanism, such as, for instance, a sensor 112 to measure, for example, a physical characteristic of the pages in the stack 109. In one embodiment, after the binder 103 and the clamp mechanism 106 of the binding machine 100 are secured around the pages of the stack 109, the sensor 112 may measure an actual physical characteristic of the pages in the stack 109 in order to verify that the stack 109 comprises the correct number of pages as will be described. In one embodiment, the physical characteristic is the thickness of the stack 109. In another embodiment, the physical characteristic is the weight of the stack 109 or other characteristic.

Associated with the binding machine 100 is a control system 118 that orchestrates the operation of the binding machine 100 as will be described. The control system 118 may comprise, for example, one or more processor based systems, and/or other systems. In one embodiment, the control system 118 may communicate with other systems via an appropriate network, such as, a local area network, wireless network, or other type of network as can be appreciated.

Additionally, stored within the memory accessible to the control system 118 is book data 121 comprising data about one or more physical characteristics of the pages in a stack 109, such as, for example, the expected thickness of the pages in the stack 109, the expected weight of the pages in the stack 109, the expected dimensions of the pages in the stack 109, as well as any other physical characteristics. The book data 121 may take the form, for example, of a look-up table or other data structure that is indexed by a book identifier. Alternatively, in one embodiment, the book data 121 is retrieved from another computing device accessible to the control system 118 through a network (not shown).

Associated with the control system 118 is an identifier system 124, such as, for example, a radio frequency identification (RFID) reader system, a bar code reader system, or other reader system as can be appreciated. During operation, a reader device 130, such as, for example, a hand held scanner, or other input device, may be used to provide an identifier 127 associated with the pages of the stack 109 to the identifier system 124. In one embodiment, this identifier 127 is used to obtain an expected physical characteristic of the pages of the stack 109 as will be described. Such an identifier 127 may be expressed as bar codes, such as, one dimensional (1D) code, two dimensional (2D) code, or other characters. To this end, the identifier 127 may comprise, for example, Universal Product Codes (UPC), European articles numbers (EAN), or other product identification codes as can be appreciated. Additionally, in one embodiment, the identifier 127 may comprise, for example, an RFID tag. The RFID tag may be, for example, passive, active, or battery assisted passive.

Next, a description of the general operation of the binding machine 100 is provided according to various embodiments. The pages of a stack 109 may be transported to a binding machine 100, where one or more pages of the stack 109 are associated with identifier 127 conveying information about, for example, an expected physical characteristic of the pages of the stack 109. In one embodiment, the identifier 127 may be printed on one or more of the pages in the stack 109. Alternatively, in another embodiment, the identifier 127 may be affixed to one or more pages in the stack 109, where the identifier 127 is embedded in a label, etc.

For any given stack 109 that reaches the binding machine 100, personnel at the binding machine 100 may input the identifier 127 associated with the pages of the stack 109 into an identifier system 124 by using, for example, a reader device 130. Upon inputting the identifier 127 associated with the pages of the stack 109, the control system 118 may then obtain an expected physical characteristic of the pages of the stack 109 based upon the identifier 127.

In one embodiment, the control system 118 may obtain the expected physical characteristic of the pages in the stack 109 from the book data 121 accessible to the control system 118 as described above. Alternatively, in another embodiment, the expected physical characteristic of the pages of the stack 109 is embedded within the identifier 127. In such an embodiment, the control system 118 may directly obtain the expected physical characteristic of the pages of the stack 109 from the identifier 127 as can be appreciated.

Upon identifying the expected physical characteristic of the pages of the stack 109, the control system 118 may then render the expected physical characteristic on an appropriate output device 136, for example, a display, an LED panel, etc. In one embodiment, the control system 118 may render for display the expected physical characteristic of the pages of the stack 109, for example, in a user interface 139 presented on the output device 136, for viewing by personnel stationed at the binding machine 100.

Thereafter, personnel at the binding machine 100 may place the pages of the stack 109 onto the binder 103. As described above, in one embodiment, the clamp mechanism 106 may then close around the pages of the stack 109, wherein the sensor 112 may then measure an actual physical characteristic of the pages of the stack 109. The sensor 112 may then provide the actual physical characteristic of the pages of the stack 109 to the control system 118. The control system 118 may then render the actual physical characteristic of the pages of the stack 109 for display on the user interface 139.

Subsequently, the control system 118 may compare the expected physical characteristic of the pages of the stack 109 based upon the identifier 127 to the actual physical characteristic of the pages of the stack 109 obtained from the sensor 112. In one embodiment, if the expected physical characteristic does not match, or does not fall within a predefined delta of the actual physical characteristic of the pages of the stack 109 obtained from the sensor 112, then the control system 118 may initiate, for example, a stop of the binding machine 100. Additionally, the control system 118 may notify personnel at the binding machine 100 that the stack 109 does not include the proper number of pages by rendering, for instance, an error message for display on the user interface 139, through an audio notification, or using any other type of alert as can be appreciated.

To this end, the control system 118 is configured to alert personnel at the binding machine 100 that the stack 109 does not include the proper number of pages. Such would be the case, if, for example, personnel accidentally placed the pages of two stacks 109 on the binder 103 of the binding machine 100. For instance, if the expected physical characteristic of the pages of the stack 109 is a thickness of 0.50 inches and the predefined delta is 0.03 inches, then the control system 118 would initiate a stop of the binding machine 100 if the actual physical characteristic of the pages of the stack 109 is greater than 0.53 inches or less than 0.47 inches. As another example, if the physical characteristic is weight, and the expected weight of the pages of the stack 109 is 2.70 pounds and the predefined delta is 0.01 pounds, then the control system 118 would initiate a stop of the binding machine 100 if the actual weight of the pages of the stack 109 is greater than 2.71 pounds or less than 2.69 pounds.

Figure 2:
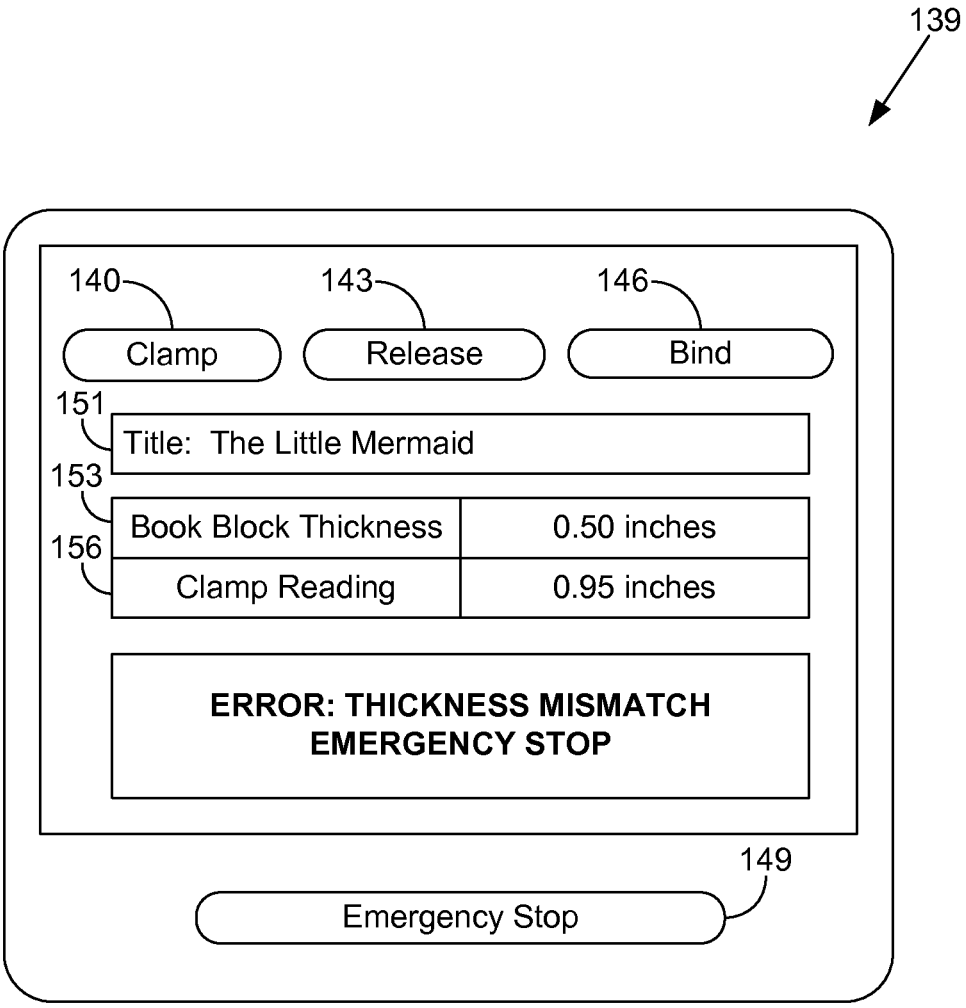
FIG. 2 is a drawing of an example of a user interface rendered for display by a control system of the binding machine of FIG. 1 according to various embodiments of the present disclosure.

Referring now to FIG. 2, shown is a non-limiting example of a user interface 139 (FIG. 1) generated by a control system 118 (FIG. 1) of a binding machine 100 (FIG. 1).

In one embodiment, the user interface 139 may comprise various control buttons, such as, for example, a clamp button 140, a release button 143, a bind button 146, an emergency stop button 149, and potentially other control buttons that may be selected by personnel operating the binding machine 100. To this end, the control system 118 may initiate various operations based upon selection of the control buttons, such as, for example, closing the clamp mechanism 106 (FIG. 1) around the pages of a stack 109 (FIG. 1) if the clamp button 140 is selected, releasing the clamp mechanism 106 if the release button 143 is selected, binding a cover to the pages of the stack 109 if the bind button 146 is selected, and stopping the operations of the binding machine 100 if the emergency stop button 149 is selected. The user interface 139 may further comprise other control buttons that may be selected to initiate other operations of the binding machine 100 as can be appreciated.

In addition, the user interface 139 may display various information associated with the pages of the stack 109, such as, for example, a title of the printed content corresponding to the pages of the stack 109, the expected thickness of the pages of the stack 109 based upon an identifier 127 (FIG. 1), the actual thickness of the pages of the stack 109 obtained from the sensor 112 (FIG. 1), an expected weight of the pages of the stack 109, and potentially other information as can be appreciated. In one embodiment, the control system 118 may also render an error message for display on the user interface 139 to inform personnel if the expected thickness of the pages of the stack 109 based on the identifier 127 does not match the actual thickness of the pages of the stack 109 obtained by the sensor 112, thereby preventing the binding of the pages of the stack 109 where an error is apparent.

As a non-limiting example, as shown in FIG. 2, the pages of the stack 109 are associated with the work entitled, "The Little Mermaid," having an expected thickness of 0.50 inches, and an actual thickness 153 of 0.95 inches. Assuming that the predefined delta is 0.02 inches, in this example, the control system 118 may also render an error message of "Error: Thickness Mismatch. Emergency Stop" for display on the user interface 139. To this end, the error message displayed on the user interface 139 may inform personnel stationed at the binding machine 100 that the stack 109 does not include the correct number of pages.

Figure 3:
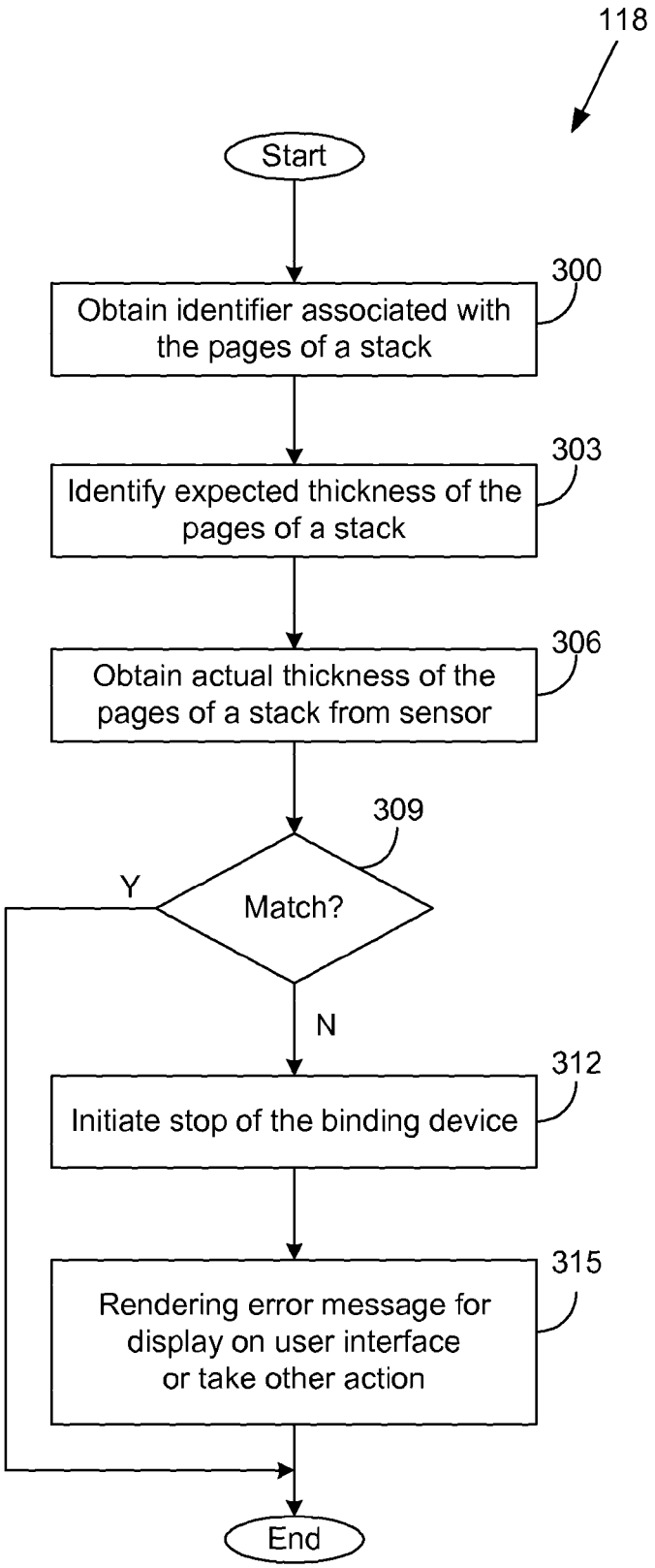
FIG. 3 is a flowchart illustrating one example of functionality implemented as portions of a control system executed in a computing device in the binding machine of FIG. 1 according to various embodiments of the present disclosure.

Referring next to FIG. 3, shown is a flowchart that provides one example of the operation of a portion of the control system 118 (FIG. 1) according to various embodiments. It is understood that the flowchart of FIG. 3 provides merely an example of the many different types of functional arrangements that may be employed to implement the operation of the portion of the control system 118 as described herein. As an alternative, the flowchart of FIG. 3 may be viewed as depicting an example of steps of a method implemented in the control system 118 according to one or more embodiments.

To begin, in box 300, the control system 118 obtains an identifier 127 (FIG. 1) associated with one or more pages of a stack 109 (FIG. 1) provided to an identifier system 124 (FIG. 1) using an appropriate reader device 130 (FIG. 1) as described above. Then, in box 303, the control system 118 identifies an expected thickness associated with the pages of the stack 109 based upon the identifier 127. Then, in box 306, the control system 118 obtains an actual thickness of the pages of the stack 109 from a sensor 112 (FIG. 1). Thereafter, in box 309, the control system 118 determines if the expected thickness based upon the identifier 127 falls within a predefined delta of the actual thickness of the pages of the stack 109 obtained from the sensor 112. If so, then the control system 118 ends as shown. Alternatively, if, at box 309, it is determined that the actual thickness of the pages of the stack 109 falls outside the predefined delta of the expected thickness of the pages of the stack 109, then, in box 312, the control system 118 initiates a stop of the binding machine 100. Lastly, in box 315, the control system 118 renders an error message for display on the user interface 139, or may take other appropriate action, such as, rendering a visual notification, for example, an indicator light, an audio notification, such as, an audio alarm, or rendering any other type of alert as can be appreciated, such as, initiating a machine rejection system to prevent placing another stack of pages on the binder 103 of the binding device 100. The control system 118 then ends as shown.

Additionally, the control system 118 may notify personnel at the binding machine 100 that the stack 109 does not include the proper number of pages by rendering, for instance, an error message for display on the user interface 139, through an audio notification, or using any other type of alert as can be appreciated.

Figure 4:
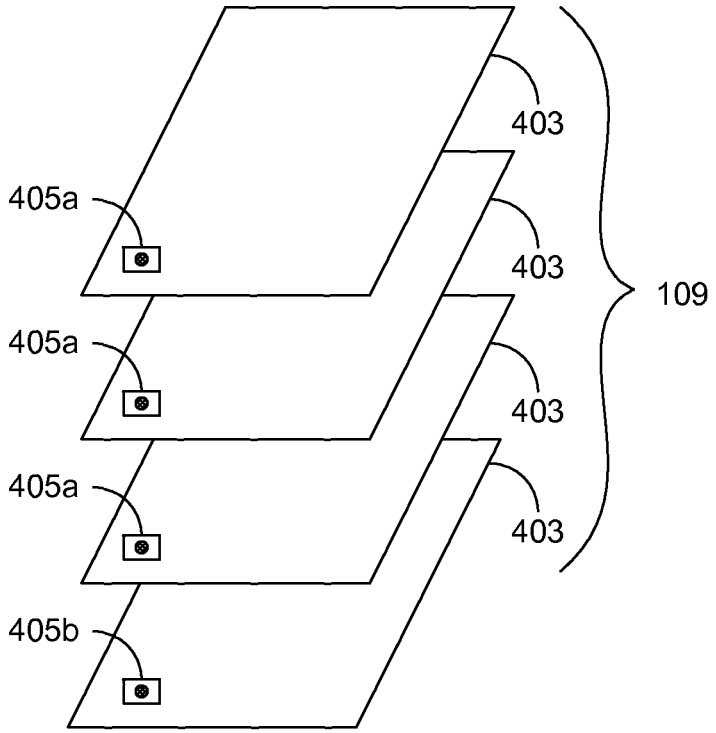
FIG. 4 is a drawing of an example of a stack of pages having identifiers according to various embodiments of the present disclosure.

With reference to FIG. 4, shown is a drawing that depicts an example of a stack 109 comprising pages 403, where an identifier 405 is associated with each of the pages 403, the identifier being denoted herein as 405*a* and 405*b*. In one embodiment, a reader device 130 (FIG. 1) may be used to read the pages 403 in the stack 109 in order to determine if multiple different identifiers 405*a*, 405*b* are associated with the pages 403 in the stack 109. For example, each identifier 405 may comprise an RFID tag, where all such identifiers 405 are generated at the same time by an RFID system. In one embodiment, if the pages 403 in the stack 109 are associated with more than one identifier 405, then the control system 118 may initiate, for example, a stop of a binding machine 100 (FIG. 1) and/or generate an alert to notify personnel at the binding machine 100 that the pages 403 of the stack 109 may correspond to different books or other printed content.

As a non-limiting example, as shown in FIG. 4, the control system 118 may initiate a stop of the binding machine 100 because the pages 403 of the stack 400 are associated with identifiers 405*a* and 405*b*, thereby indicating that the stack 400 comprises pages 403 of different books or other printed content.

Figure 5:
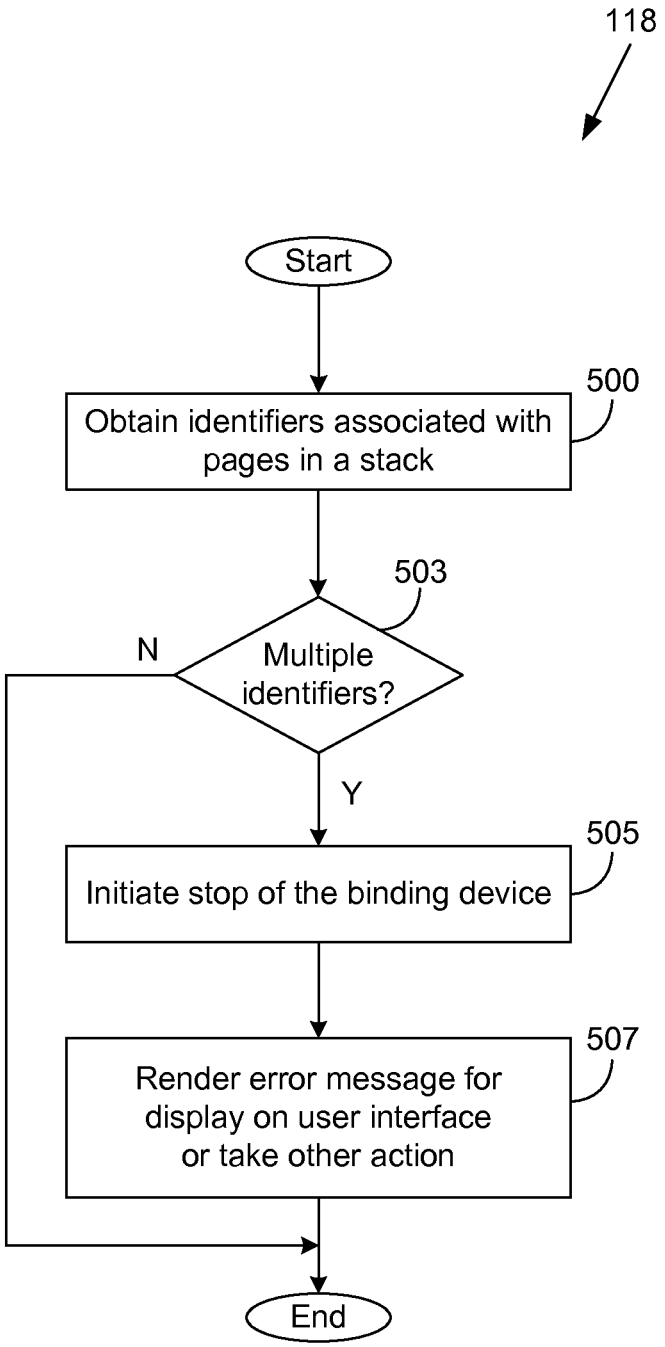
FIG. 5 is a flowchart illustrating another example of functionality implemented as portions of the control system executed in a computing device in the binding machine of FIG. 1 according to various embodiments of the present disclosure.

Referring next to FIG. 5, shown is a flowchart that provides one example of the operation of a portion of the control system 118 (FIG. 1) according to various embodiments. It is understood that the flowchart of FIG. 5 provides merely an example of the many different types of functional arrangements that may be employed to implement the operation of the portion of the control system 118 as described herein. As an alternative, the flowchart of FIG. 5 may be viewed as depicting an example of steps of a method implemented in the control system 118 according to one or more embodiments.

To begin, in box 500, the control system 118 obtains one or more identifiers 127 associated with each of the pages in the stack 109. Thereafter, in box 503, the control system 118 determines if more than one identifier 127 is detected. If the control system 118 determines that the pages in the stack 109 are associated with only identifier 127, then the control system 118 ends as shown. If, however, the pages in the stack 109 are associated with more than one identifier 127, then in box 505, the control system 118 initiates a stop of the binding machine 100. This is because the pages of more than one publication have been combined. Lastly, in box 507, the control system 118 renders an error message for display on a user interface 139 (FIG. 1) to indicate that the pages of the stack 109 are associated with multiple identifiers 127, or may take other appropriate action, such as, rendering a visual notification, for example, an indicator light, an audio notification, such as, an audio alarm, or rendering any other type of alert as can be appreciated, such as, initiating a machine rejection system to prevent placing another stack of pages onto the binder 103 of the binding device 100.

Figure 6:
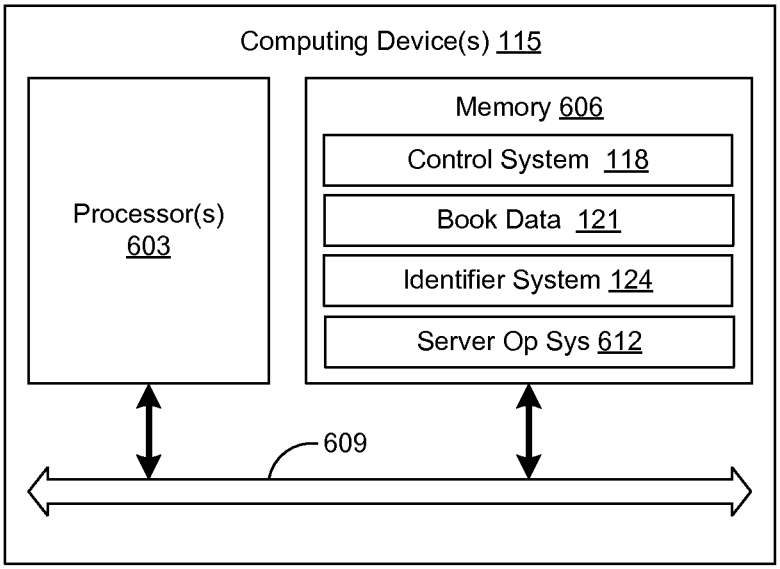
FIG. 6 is a schematic block diagram that provides one example illustration of a computing device upon which the portions of the control system of FIGS. 3 and 5 are executed according to various embodiments of the present disclosure.

With reference to FIG. 6, shown is a schematic block diagram of one example of a computing device 115 according to an embodiment of the present disclosure. The computing device 115 includes at least one processor circuit, for example, having a processor 603 and a memory 606, both of which are coupled to a local interface 609. To this end, the computing device 115 may comprise, for example, at least one server computer or like device. The local interface 609 may comprise, for example, a data bus with an accompanying address/control bus or other bus structure as can be appreciated.

Stored in the memory 606 are both data and several components that are executable by the processor 603. In particular, stored in the memory 606 and executable by the processor 603 is a control system 118, an identifier system 124, and potentially other applications. In addition, a server operating system 612 may be stored in the memory 606 and executable by the processor 603.

It is understood that there may be other applications that are stored in the memory 606 and are executable by the processors 603 as can be appreciated. Where any component discussed herein is implemented in the form of software, any one of a number of programming languages may be employed such as, for example, C, C++, C#, Objective C, Java, Javascript, Perl, PHP, Visual Basic, Python, Ruby, Delphi, Flash, or other programming languages.

A number of software components are stored in the memory 606 and are executable by the processor 603. In this respect, the term "executable" means a program file that is in a form that can ultimately be run by the processor 603.

Examples of executable programs may be, for example, a compiled program that can be translated into machine code in a format that can be loaded into a random access portion of the memory 606 and run by the processor 603, source code that may be expressed in proper format such as object code that is capable of being loaded into a random access portion of the memory 606 and executed by the processor 603, or source code that may be interpreted by another executable program to generate instructions in a random access portion of the memory 606 to be executed by the processor 603, etc. An executable program may be stored in any portion or component of the memory 606 including, for example, random access memory (RAM), read-only memory (ROM), hard drive, solid-state drive, USB flash drive, memory card, optical disc such as compact disc (CD) or digital versatile disc (DVD), floppy disk, magnetic tape, or other memory components.

The memory 606 is defined herein as including both volatile and nonvolatile memory and data storage components. Volatile components are those that do not retain data values upon loss of power. Nonvolatile components are those that retain data upon a loss of power. Thus, the memory 606 may comprise, for example, random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, the RAM may comprise, for example, static random access memory (SRAM), dynamic random access memory (DRAM), or magnetic random access memory (MRAM) and other such devices. The ROM may comprise, for example, a programmable read-only memory (PROM), an erasable programmable read-only memory (EPROM), an electrically erasable programmable read-only memory (EEPROM), or other like memory device.

Also, the processor 603 may represent multiple processors 603 and the memory 606 may represent multiple memories 606 that operate in parallel processing circuits, respectively. In such a case, the local interface 609 may be an appropriate network that facilitates communication between any two of the multiple processors 603, between any processor 603 and any of the memories 606, or between any two of the memories 606, etc. The local interface 609 may comprise additional systems designed to coordinate this communication, including, for example, performing load balancing. The processor 603 may be of electrical or of some other available construction.

Although the control system 118, the identifier system 124, and other various systems described herein may be embodied in software or code executed by general purpose hardware as discussed above, as an alternative the same may also be embodied in dedicated hardware or a combination of software/general purpose hardware and dedicated hardware. If embodied in dedicated hardware, each can be implemented as a circuit or state machine that employs any one of or a combination of a number of technologies. These technologies may include, but are not limited to, discrete logic circuits having logic gates for implementing various logic functions upon an application of one or more data signals, application specific integrated circuits having appropriate logic gates, or other components, etc. Such technologies are generally well known by those skilled in the art and, consequently, are not described in detail herein.

The flowcharts of FIGS. 3 and 5 show the functionality and operation of an implementation of portions of the control system 118. If embodied in software, each block may represent a module, segment, or portion of code that comprises program instructions to implement the specified logical function(s). The program instructions may be embodied in the form of source code that comprises human-readable statements written in a programming language or machine code that comprises numerical instructions recognizable by a suitable execution system such as a processor 603 in a computer system or other system. The machine code may be converted from the source code, etc. If embodied in hardware, each block may represent a circuit or a number of interconnected circuits to implement the specified logical function(s).

Although the flowcharts of FIGS. 3 and 5 show a specific order of execution, it is understood that the order of execution may differ from that which is depicted. For example, the order of execution of two or more blocks may be scrambled relative to the order shown. Also, two or more blocks shown in succession in FIGS. 3 and 5 may be executed concurrently or with partial concurrence. Further, in some embodiments, one or more of the blocks shown in FIGS. 3 and 5 may be skipped or omitted. In addition, any number of counters, state variables, warning semaphores, or messages might be added to the logical flow described herein, for purposes of enhanced utility, accounting, performance measurement, or providing troubleshooting aids, etc. It is understood that all such variations are within the scope of the present disclosure.

Also, any logic or application described herein, including the control system 118, the identifier system 124, that comprises software or code can be embodied in any non-transitory computer-readable medium for use by or in connection with an instruction execution system such as, for example, a processor 603 in a computer system or other system. In this sense, the logic may comprise, for example, statements including instructions and declarations that can be fetched from the computer-readable medium and executed by the instruction execution system. In the context of the present disclosure, a "computer-readable medium" can be any medium that can contain, store, or maintain the logic or application described herein for use by or in connection with the instruction execution system. The computer-readable medium can comprise any one of many physical media such as, for example, magnetic, optical, or semiconductor media. More specific examples of a suitable computer-readable medium would include, but are not limited to, magnetic tapes, magnetic floppy diskettes, magnetic hard drives, memory cards, solid-state drives, USB flash drives, or optical discs. Also, the computer-readable medium may be a random access memory (RAM) including, for example, static random access memory (SRAM) and dynamic random access memory (DRAM), or magnetic random access memory (MRAM). In addition, the computer-readable medium may be a read-only memory (ROM), a programmable read-only memory (PROM), an erasable programmable read-only memory (EPROM), an electrically erasable programmable read-only memory (EEPROM), or other type of memory device.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

For the Examiner's convenience, Applicant notes that this application is a continuation of U.S. application Ser. No. 13/303,708. The claims of the present application are different and possibly, at least in some aspects, broader in scope than the claims pursued in the parent application. To the extent any prior amendments or characterizations of the scope of any claim or cited document made during prosecution of the parent could be construed as a disclaimer of any subject matter supported by the present disclosure, Applicant hereby rescinds and retracts such disclaimer. Accordingly, the references previously presented in the parent applications may need to be revisited.

Therefore, the following is claimed:

1. A non-transitory computer-readable medium embodying a program executable in a computing device, the program comprising machine readable instructions that, when executed, cause the computing device to at least:

generate an expected value for a physical characteristic of a plurality of pages in a stack;

store the expected value in a memory;

identify the expected value based upon an input of an identifier associated with the pages in the stack;

obtain an actual value of the physical characteristic of the plurality of pages in the stack corresponding to the expected value, wherein the actual value is obtained from a sensor in data communication with a binding device, wherein the sensor is used to measure the actual value of the physical characteristic of the plurality of pages in the stack;

compare, before binding the plurality of pages in the stack, the expected value with the actual value; and initiate a stop of the binding device if the actual value is not within a predefined delta of the expected value.

2. The non-transitory computer-readable medium of claim 1, further comprising machine readable instructions that cause the computing device to at least render an error message for display on a user interface if the expected value does not match the actual value.

3. The non-transitory computer-readable medium of claim 1, further comprising machine readable instructions that cause the computing device to at least render the expected value for display on a user interface.

4. A system, comprising:

a computing device comprising a processor and a memory;

an input device in data communication with the computing device configured to input an identifier associated with at least one of a plurality of pages in a stack;

a sensor in data communication with the computing device, the sensor configured to measure an actual value of a physical characteristic of the plurality of pages in the stack;

machine readable instructions stored in the memory that, when executed by the processor, cause the computing device to at least:

obtain an expected value of the physical characteristic based at least in part on the identifier;

compare, before the plurality of pages in the stack are bound, the actual value and the expected value; and initiate a stop of a binding device if the actual value is not within a predefined delta of the expected value.

5. The system of claim 4, wherein the machine readable instructions that cause the computing device to obtain the expected value based at least in part on the identifier further comprise machine readable instructions that cause the computing device to look up the expected value in a table in a memory using the identifier.

6. The system of claim 4, wherein the machine readable instructions that cause the computing device to at least obtain the expected value based at least in part on the identifier further comprise machine readable instructions that cause the computing device to at least extract the expected value from the identifier.

7. The system of claim 4, wherein the machine readable instructions that cause the computing device to at least obtain the expected value based at least in part on the identifier further comprise machine readable instructions that cause the computing device to at least obtain the expected value from another computing device.

8. The system of claim 4, wherein the binding device is configured to bind the pages in the stack to a cover.

9. The system of claim 4, wherein the plurality of pages in the stack are available for purchase through an electronic commerce system.

10. The system of claim 4, further comprising:

an output device in data communication with the computing device; and the machine readable instructions further cause the computing device to at least:

render the expected value associated with the plurality of pages in the stack for display on a user interface; and render the actual value of the plurality of pages in the stack for display on the user interface.

11. The system of claim 4, wherein the machine readable instructions further cause the computing device to render an error message on a user interface if the actual value of the physical characteristic of the plurality of pages in the stack is not within the predefined delta of the expected value.

12. The system of claim 4, wherein the machine readable instructions further cause the computing device to at least initiate an alert to notify a user if the actual value of the physical characteristic of the plurality of pages in the stack is not within the predefined delta of the expected value.

13. The system of claim 4, wherein the machine readable instructions further cause the computing device to at least render a title associated with the pages in the stack on a user interface of the application in response to the input of the identifier through the input device.

14. A computer-implemented method, comprising: obtaining, from an input device in data communication with a computer system, a value representing an expected physical characteristic from an identifier located on at least one of a plurality of pages; obtaining, via the computer system, a reading from a sensor, the sensor being in data communication with the computer system and the reading including a representation of an actual value of a physical characteristic associated with the plurality of pages; comparing, the value representing the expected physical characteristic with the reading; and initiating a stop of a binding device when the value is not within a predefined delta of the actual value.

15. The computer-implemented method of claim 14, wherein the expected physical characteristic comprises at least one of: a weight of the plurality of pages, a thickness of the plurality of pages, a height of the plurality of pages, or a width of the plurality of pages.

16. The computer-implemented method of claim 14, further comprising rendering an error message on a display device if the value representing the expected physical characteristic is not within a predefined delta of the actual value.

17. The computer-implemented method of claim 14, further comprising rendering, via the computer system, a title associated with the plurality of pages on a user interface of the computer system in response to obtaining the identifier.

18. The computer-implemented method of claim 14, wherein obtaining the value from the identifier on the at least one of the pages further comprises:

scanning the identifier into the computer system through the input device; and looking up, via the computer system, the value in a memory based upon the identifier.

19. The computer-implemented method of claim 14, further comprising:

rendering, via the computer system, the value based upon the identifier on a display device associated with the computer system; and rendering, via the computer system, the on the display device.

20. The computer-implemented method of claim 14, wherein the plurality of pages in the stack are available for purchase through an electronic commerce system.

* * * * *